United States Patent [19]

Vuilleumier et al.

[11] 4,408,898

[45] Oct. 11, 1983

[54] POSITIONING MECHANISM FOR A CENTER WHEEL

[75] Inventors: Cyril Vuilleumier; Bruno Erni, both of Bienne, Switzerland

[73] Assignee: Societe Suisse pour l'Industrie Horlogere Management Services S.A., Bienne, Switzerland

[21] Appl. No.: 206,228

[22] Filed: Nov. 12, 1980

[30] Foreign Application Priority Data

Nov. 16, 1979 [FR] France ..... 79 28761

[51] Int. Cl.[3] ..... G04B 19/02

[52] U.S. Cl. ..... 368/220; 368/228; 368/185

[58] Field of Search ..... 368/220, 221, 223, 228, 368/157, 160, 185, 76, 80, 78, 107–114

[56] References Cited

U.S. PATENT DOCUMENTS

| | | | |
|---|---|---|---|
| 2,766,578 | 10/1956 | Robert-Charrue | 368/220 |
| 3,487,633 | 1/1970 | Wuthrich | 368/220 |
| 3,691,753 | 9/1972 | Kurita | 368/204 |
| 3,783,608 | 1/1974 | Miyazawa | 368/220 |

FOREIGN PATENT DOCUMENTS

| | | | |
|---|---|---|---|
| 1932285 | 1/1971 | Fed. Rep. of Germany . | |
| 2647634 | 5/1977 | Fed. Rep. of Germany . | |
| 1421043 | 1/1964 | France . | |
| 184666 | 9/1936 | Switzerland | 368/220 |

*Primary Examiner*—Bernard Roskoski

*Attorney, Agent, or Firm*—Griffin, Branigan & Butler

[57] ABSTRACT

The invention provides a positioning mechanism for a center wheel in a timepiece enabling precision positioning for the seconds or minutes hand relative to the dial divisions. It comprises a jumper spring (1) friction mounted onto the base plate and cooperating with the teeth (3) of the center wheel (4) and a wheel member (29) interposed between the center wheel (4) and the motor pinion (14). The wheel member includes a pinion (17) meshing with the center wheel as well as a gear (16) friction mounted relative to said pinion and meshing with the motor pinion. The positioning method consists of immobilizing the motor pinion then turning the center wheel to bring the end of the jumper spring into coincidence with a tooth space thereof. The invention is employed to position exactly the seconds or minutes hand of an electronic timepiece having a stepping motor.

6 Claims, 3 Drawing Figures

POSITIONING MECHANISM FOR A CENTER WHEEL

BACKGROUND OF THE INVENTION

This invention comprises a positioning mechanism for a centre wheel in an electronic timepiece with analog display and comprises a jumper spring of which one end is terminated in two inclined planes cooperating with the teeth of the centre wheel and the other end is friction mounted for rotation onto the base plate.

Such mechanism is known from the prior art and one may find application thereof in certain chronographs or certain electronic watches having analog display with the purpose of exactly positioning the seconds hand relative to the markings of the dial. A precise positioning of the hand relative to the index marking is still more desirable in electronic watches which may have only a minutes and an hours hands and wherein the minutes hand driven by a stepping motor steps through one division each minute. It will be understood that in such cases the eye of the user may well judge if the hand is properly positioned relative to the index marking which may represent a form of garantee as to the quality of manufacture of the timepiece.

The positioning of jumping seconds or minutes hands relative to a dial index depends on the play existing in the gear train found between the motor axis and the centre wheel which drives the hand, the trueness of the wheels and the regularity with which the index divisions are marked on the dial. In order to eliminate the first two of these criteria, one generally employs a positioning jumper spring which may act directly onto the teeth of the centre wheel which may drive either the minutes hand or the seconds hand. In such a manner the angular step of the hand will be always the same as that of the teeth of the wheel.

FIG. 1 shows the positioning mechanism for a centre wheel according to the prior art. This mechanism includes a jumper spring 1 formed by an elastic blade of which the first extremity may bear a ruby polyhedron 2 which cooperates with the teeth 3 of the centre wheel 4. In a simpler manner the end of the blade may simply be bent in order to form a triangle of which the two inclined planes cooperate with the teeth. The other extremity of the jumper spring 1 is fixed onto a collet 5 which may be friction fitted about an axis 6, the latter being fixed to a stud 7. In the stud are provided two oblong holes 8 and 9. Hole 8 may receive a circular pin 10 fixed to the base plate and the hole 9 a screw 11 screwed into the base plate. The centre wheel is driven by pinion 12 of an intermediate wheel 13 which meshes with the pinion 14 of a stepping motor. In order to regulate the positioning jumper spring it is necessary initially to turn the collet until the ruby 2 contacts the wheel 4 and to effect sliding of stud 7 in the axis of jumper spring 1 in a manner such that the inclined planes of the ruby bear between the outer extremities of two consecutive teeth of toothing 3, the gear backlash thus being divided in half on each side. As soon as the adjustment has been terminated the screw 11 may be tightened. Such operations are difficult and the means available are generally too coarse to assure an exact positioning. It is often necessary to repeat the operation several times since one movement may well influence the other.

It is the purpose of this invention to overcome these difficulties through proposing a positioning mechanism for the centre wheel having an easy precise adjustment and at the same time simplifying the design.

These purposes are attained through use of the claimed means.

DETAILED DESCRIPTION OF THE DRAWINGS

Figure 2:
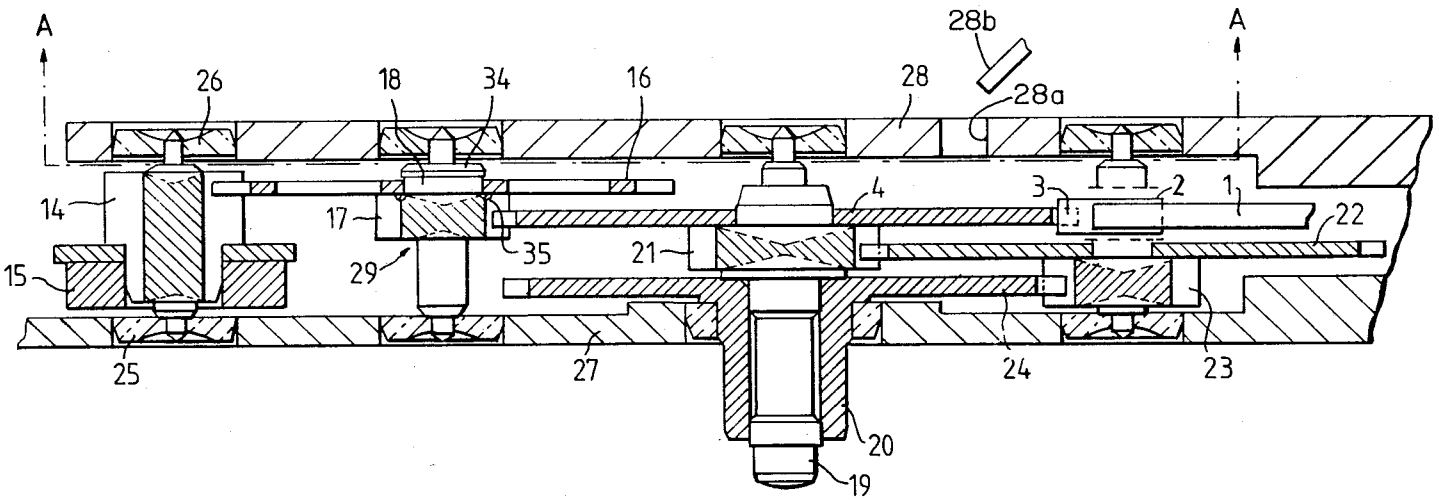
FIG. 2 is a cross section of the positioning of the centre wheel according to the invention.

FIG. 2 shows the motion work intended to drive the minutes and hours hand of a timepiece. Fixed to the permanent magnet rotor 15 of a stepping motor, motor pinion 14 drives a wheel member including a gear 16 and a pinion 17. The centre wheel 4, fixed to axis 19 bearing the minutes hand, meshes with pinion 17. Axis 20 of the hours hand is driven in rotation by the gear train comprising pinion 21 fixed to the centre wheel 4 and the motion work formed by gears 22, 23 and 24. Gear 24 is formed integrally with axis 20 bearing the hours hand. The axes of the various wheels are rotatively mounted in bearing 25 and 26 force fitted into the base plate 27 and bridge 28 of the timepiece.

Figure 3:
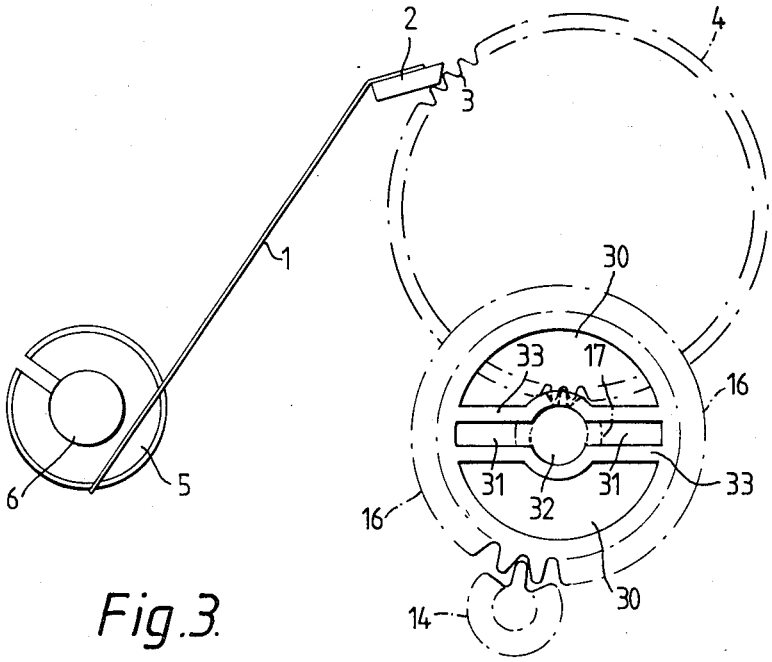
FIG. 3 is a simplified plan view of the mechanism of FIG. 2 along the dashed line AA noted on FIG. 2.

FIG. 3 is a plan view of the same mechanism along the dashed line AA seen on FIG. 2. In order to simplify the matter, FIG. 3 does not show the motion work formed from gears 21, 22, 23 and 24, this being unnecessary for the understanding of the invention.

According to the invention wheel member 29 comprises a pinion 17 meshing with the centre wheel 4 and a gear 16 friction mounted relative to pinion 17. FIG. 3 shows how gear 16 may be obtained. In addition to the standard toothing the centre portion has blanked therefrom two semi-circular portions 30 and two rectiliniar portions 31 terminating in a central circular opening 32. Thus there is obtained a gear having four spokes 33 connecting its circumference to its hub. The diameter of the central opening 32 is designed to be slightly smaller than the diameter of the stem 18 (FIG. 2) of the wheel member 29 in a manner such that when the gear is assembled onto the stem there will be a friction fit between the two elements. The friction couple is chosen on the one hand to be sufficiently high so that in normal operation of the watch transmission of motion is made without slippage and on the other hand sufficiently low so that during manual adjustment it is possible to cause angular slipping of the gear relative to the stem and thus relative to the pinion which forms a portion of the wheel member. FIG. 2 shows how the upper portion of stem 18 includes a stepped portion 34 in order to prevent gear 16 from leaving its lodging. Good seating of gear 16 is assured by arranging a circular groove 35 in pinion 17. The invention however is not limited to the above description which merely explains a preferred execution of wheel member 29. Gear 16 may for instance comprise six spokes 33 distributed around the circumference. It might also not be pierced: in such case one might superpose thereon an elastic washer which, being retained by the step portion 34, would assure the required friction.

Figure 1:
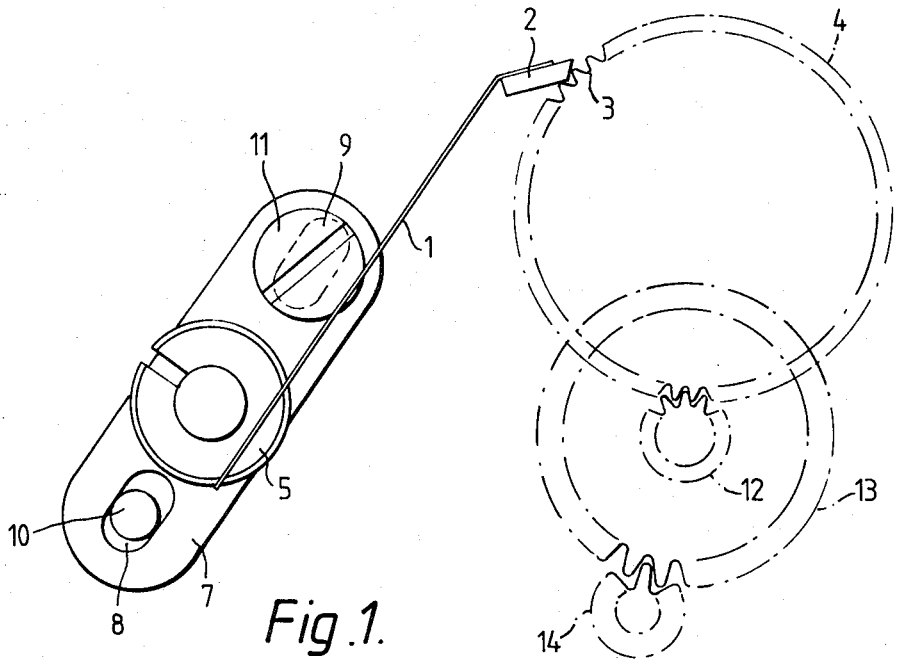
Fig.1. PRIOR ART
FIG. 1 is a plan view of a positioning mechanism of the centre wheel according to the prior art such as has been explained above.

As has been explained in respect of FIG. 1, FIGS. 2 and 3 show that the teeth 3 of the centre wheel 4 cooperate with the jumper spring 1 of which one extremity is terminated by a polyhedral ruby 2. The other extremity of the jumper spring 1 is fixed to a collet 5 which is friction fitted onto a pin 6 fixed to the base plate as may be seen on FIG. 3. Relative to the prior art this construction is notably simplified since there is no longer necessity to provide the stud 7, pin 10 and screw 11 as shown in FIG. 1.

It will now be explained how positioning of the centre wheel is obtained. Initially collet 5 is turned on pin 6 in a manner to cause the ruby 2 to come into contact with teeth 3 of the centre wheel 4 (FIG. 3). Next via an opening 28*a* in bridge 28 (FIG. 2) the centre wheel is turned by means of a suitable tool 28*b* in a manner such that the inclined planes of ruby 2 are brought to bear between the outer extremities of two consecutive teeth of toothing 3. During this second operation it will be necessary to block the motor pinion 14 this thereby immobilising gear 16 unless the pair represented by pinion 14 and gear 16 already comprises an unidirectional transmission system as has been described for example in U.S. patent application Ser. No. 127,500, filed Mar. 5, 1980, now U.S. Pat. No. 4,321,839. Under such conditions as have been described above, pinion 17 will slip relative to immobilised gear 16. Thus a centre wheel bearing the minutes hand may be positioned with precision and thereby said minutes hand during its stepping will always be found in exact correspondence with the dial divisions.

The description has mentioned a centre wheel which bears the minutes hand. The invention may naturally also apply to a centre wheel which bears the seconds hand. The invention is principally directed to an electronic timepiece comprising a stepping motor, but might equally be applied to a mechanical chronograph in order to position the seconds hand.

What we claim is:

1. Positioning mechanism for a centre wheel which is moved in steps in an electronic timepiece with analog display having an indicator attached to said centre wheel, said timepiece being of a type including a stepping motor and a jumper spring of which a first end is provided with two inclined planes adapted to cooperate with teeth of the centre wheel and the second end is rotatably mounted with friction fit into the base plate, said positioning mechanism comprising: a gear train coupled between the stepping motor and the centre wheel through which the motor drives the centre wheel in steps, said gear train comprising at least a pinion, a gear and a friction mounting means for mounting said pinion to said gear by friction which is sufficiently high so that in normal operation of the timepiece transmission of motion is made without slippage between the pinion and the gear to drive the indicator, however low enough so that it is possible to manually cause slippage of the pinion relative to the gear; means for manually causing said slippage to adjust the position of the centre wheel relative to step positions of the motor to bring the two inclined planes of the jumper spring into proper coincidence with a tooth space on said centre wheel at each tooth position for precisely positioning the indicator relative to markings of the dial of the timepiece between steps.

2. Positioning mechanism as set forth in claim 1 wherein said pinion meshes with the centre wheel and the friction mounted gear meshes with a motor pinion fixed to a motor axis.

3. Positioning mechanism as set forth in claim 1 wherein the centre wheel drives a seconds hand.

4. Positioning mechanism as set forth in claim 1 wherein the centre wheel drives a minutes hand.

5. Positioning mechanism as set forth in claim 1 wherein the friction mounted gear includes in its central portion a friction spring blanked from the gear itself, said spring being elastically coupled onto the stem of the pinion.

6. A positioning method for a centre wheel of an electronic timepiece of a type comprising an analog display having a jumper spring of which a first end is provided with two inclined planes adapted to cooperate with teeth of the centre wheel and a second end is rotatably mounted with friction fit onto a base plate, wherein a stepping motor is arranged to drive the centre wheel via a gear train comprising a pinion and a gear friction mounted relative to said pinion, said pinion meshing with the centre wheel and the gear meshing with a motor-driven pinion, the method comprising the following steps:

bringing the two inclined planes of the jumper spring to bear on the teeth of the centre wheel by rotating said jumper spring;

immobilizing said motor pinion;

angularly displacing the centre wheel and causing slippage of the pinion relative to the associated friction mounted gear until the two inclined planes of the jumper spring bear between the outer extremities of two consecutive teeth of the centre wheel.

* * * * *